US010578382B1

(12) United States Patent
Melnikov

(10) Patent No.: US 10,578,382 B1
(45) Date of Patent: Mar. 3, 2020

(54) AUXILIARY CALIBER WEAPON SYSTEM

(71) Applicant: Vitaliy Melnikov, Valley Village, CA (US)

(72) Inventor: Vitaliy Melnikov, Valley Village, CA (US)

( * ) Notice: Subject to any disclaimer, the term of this patent is extended or adjusted under 35 U.S.C. 154(b) by 0 days.

(21) Appl. No.: 16/165,524

(22) Filed: Oct. 19, 2018

(51) Int. Cl.

| | |
|---|---|
| ***F41A 21/00*** | (2006.01) |
| ***F41A 11/02*** | (2006.01) |
| ***F41A 21/18*** | (2006.01) |
| ***F41A 21/06*** | (2006.01) |
| ***F42B 8/10*** | (2006.01) |
| *F41C 7/02* | (2006.01) |

(52) U.S. Cl.
CPC ..... *F41A 11/02* (2013.01); *F41A 21/06* (2013.01); *F41A 21/18* (2013.01); *F42B 8/10* (2013.01); *F41C 7/02* (2013.01)

(58) Field of Classification Search
CPC ..... F41A 21/00; F41A 21/48; F41A 11/00; F41A 11/02; F41C 7/00
USPC ..... 42/77
See application file for complete search history.

(56) References Cited

U.S. PATENT DOCUMENTS

| | | | |
|---|---|---|---|
| 1,191,618 | A | 7/1916 | Safford |
| 2,059,658 | A | 11/1936 | Sandine |
| 2,321,737 | A | 6/1943 | Engel |
| 2,352,476 | A | 6/1944 | French |
| 3,156,995 | A | 11/1964 | Mellor et al. |
| 3,339,304 | A | 9/1967 | Knode, Jr. et al. |
| 3,726,231 | A | 4/1973 | Kelly et al. |
| 3,895,434 | A | 7/1975 | Adams et al. |
| 4,430,940 | A | 2/1984 | Jermunson |
| 4,494,332 | A | 1/1985 | Matievich |
| 4,519,156 | A | 5/1985 | Shaw |
| 4,867,039 | A | 9/1989 | Dobbins |
| 4,989,359 | A | 2/1991 | Kinkner et al. |
| 5,012,744 | A | 5/1991 | Sowash |
| 5,016,538 | A | 5/1991 | Sowash |
| 5,157,210 | A | 10/1992 | Davis |
| 5,341,587 | A | 8/1994 | Phillips, Jr. |
| 5,388,523 | A | 2/1995 | Rossmann |
| 5,706,599 | A | 1/1998 | Knight |

(Continued)

*Primary Examiner* — J. Woodrow Eldred

(57) ABSTRACT

An auxiliary caliber weapon system that allows a conventional shotgun, such as a pump action shotgun or other firearm, including artillery weapons to be modified to fire ammunition rounds of a selectable caliber. The system includes a barrel assembly and to load an ammunition round within the shotgun or other firearm and a shotgun shell adapter of a selected auxiliary caliber is utilized. The shotgun includes a stock with grip a receiver and an internal magazine. The shotgun barrel is removed and the system's barrel assembly is attached to the shotgun, interfacing with the receiver. An ammunition round of a selected auxiliary caliber is inserted into the adapter, which is then placed into the magazine via a loading port. When the shotgun pump is actuated the adapter with the auxiliary caliber round is loaded from the magazine into the receiver, and is ready to be fired. After being fired, the pump is actuated again causing the adapter to be ejected out an ejection port and another adapter with an auxiliary caliber round to be loaded. For use with an artillery weapon, the adapter is scaled to a larger dimension to accommodate the larger size ammunition used but the functionality is the same.

15 Claims, 10 Drawing Sheets

(56) References Cited

U.S. PATENT DOCUMENTS

| | | | | |
|---|---|---|---|---|
| 5,987,797 | A | 11/1999 | Dustin | |
| 6,513,274 | B1 | 2/2003 | Vastag | |
| 6,606,952 | B2 * | 8/2003 | Vallender | F42B 7/04 102/446 |
| 7,007,609 | B2 | 3/2006 | Meyer et al. | |
| 7,062,875 | B1 * | 6/2006 | Stevens | F41A 11/00 42/77 |
| 7,631,453 | B2 * | 12/2009 | Longueira | F41C 7/00 42/16 |
| 8,714,144 | B2 | 5/2014 | Zadra | |
| 9,074,832 | B1 | 7/2015 | Collins | |
| 9,441,899 | B2 | 9/2016 | Micklethwaite | |
| 9,541,343 | B2 | 1/2017 | Dodson | |
| 9,719,762 | B2 | 8/2017 | Langenbeck | |
| 2009/0133310 | A1 * | 5/2009 | Wossner | F41A 17/44 42/77 |
| 2010/0059032 | A1 | 3/2010 | Zabra | |
| 2010/0281744 | A1 * | 11/2010 | Meyer | F41A 21/10 42/77 |

* cited by examiner

AUXILIARY CALIBER WEAPON SYSTEM

TECHNICAL FIELD

The invention generally pertains to firearms, guns and artillery, and more particularly to a system that allows a conventional weapon to be quickly and easily modified to fire ammunition that can be used as an auxiliary selected caliber for target practice training or other purposes.

BACKGROUND ART

There are many various firearms used throughout the world for a variety of purposes including military, home/personal defense, hunting, sport/target shooting, or collecting. There are multiple types of guns or firearms: handguns, rifles, shotguns and artillery weapons including cannons. Although all of these firearms can each be utilized for multiple purposes, there are specific purposes for which a particular type of gun might be especially well-suited. For example, bird hunting (or skeet shooting) typically requires the use of a shotgun, when carrying (or wearing) a gun for personal protection a handgun is preferred, and military training often requires the use of the artillery weapons.

Other than the type of firearm, a main method of differentiating firearms is by the caliber of the ammunition (or bullet) that the firearm uses or, in the case of a shotgun, the gauge of the shell. For both rifles and handguns, the calibers can typically range from 0.22 to 0.50, with metric sizes also sometimes used. The caliber indicates the diameter of the bullet, or in some metric sizes both the diameter and length. Usually, the main difference between handgun, rifle and artillery ammunition is the actual size of the shell (which is the bullet and cartridge case that maintains the primer and gunpowder). Handgun ammunition is typically smaller than rifle ammunition, which allows the rifle cartridge to use a larger amount of gunpowder, resulting in the rifle having greater velocity and more power when fired. The longer barrels used for rifles also results in greater velocity and more power compared to handguns. This also applies to artillery weapons which have much larger and longer barrels that allow a round to be fired with great power a long distance.

Having many choices when deciding which particular type of firearm and caliber is generally a benefit. There are problems though. One major problem is that when a person does require multiple guns with different calibers. The most common solution is to acquire however many guns/calibers are necessary. This can be expensive and when the guns are not in use they must be safely stored. This problem is exacerbated when a person is away from their residence, such as when they are on a camping and hunting trip. In this scenario, when multiple guns are necessary, the person has no choice but to bring multiple guns with them. This is very inconvenient if not difficult, the guns must be carried to a camping or hunting site, and the guns must be kept in a safe location, not exposed to the elements. Another issue is that when target shooting, usually a large number of bullets are fired. Ammunition can be expensive, and the cost adds up quickly as bullets are repeatedly fired during target shooting. Many target shooters will bring larger caliber guns along with small caliber such as a .22 or .22LR. But again, this necessitates the bringing of multiple guns to the location where the target shooting is occurring.

For artillery weapons such as a cannon, the ammunition is much more expensive, and during training a large amount of ammunition is required which results in a high cost.

Training must be performed and the only way for soldiers to become accustomed to and proficient with a cannon is to use the actual weapon.

The inventive system addresses and solves these problems by providing the ability to modify a conventional firearms or artillery weapon such as a cannon to fire ammunition other than the standard respective ammunition. For a shotgun, the system's solution is to provide interchangeable barrels, each sized to fire a selected caliber and that can be quickly and easily attached to a shotgun, along with a adapter that has the same size as a shotgun shell and therefore can be loaded into a shotgun magazine or inserted into a shotgun breach, fired, and ejected. For, an artillery weapon such as a cannon, the adapter is scaled up to a larger size that fits within the cannon. The only difference between the use for a shotgun or an artillery weapon is the size of the adapter, the functionality is the same.

A search of the prior art did not disclose any literature or patents that read directly on the claims of the instant invention. However, the following U.S. patents are considered related:

| PAT. NO. | INVENTOR | ISSUED |
|---|---|---|
| 2,059,658 | Sandine | Nov. 3, 1936 |
| 2,321,737 | Engel | Jun. 15, 1943 |

The U.S. Pat. No. 2,059,658 patent discloses a gauge reduction liner for incorporation with a shotgun of a given gauge to permit the use of smaller gauge ammunition. The invention utilizes a novel ejecting mechanism for shell of smaller gauge, constructed and arranged to be operated by the gun ejector for the larger gauge shells.

The U.S. Pat. No. 2,321,737 patent discloses a converter cartridge for use in high-powered rifle to adapt the chambers thereof for loading therein low-powered shorter cartridges. The cartridge for use particularly with bottleneck type, low-powered, center fire cartridge and equipped for easy and secure loading of the low-powered cartridge and for reloading repeatedly.

For background purposes and indicative of the art to which the invention relates, reference may be made to the following remaining patents found in the patent search.

| PAT. NO. | INVENTOR | ISSUED |
|---|---|---|
| 1,191,618 | Safford | Jul. 18, 1916 |
| 2,352,476 | French | Jun. 27, 1944 |
| 3,156,995 | Mellor, et al | Nov. 17, 1964 |
| 3,339,304 | Knode, Jr., et al | Sep. 5, 1967 |
| 3,726,231 | Kelly, et al | Apr. 10, 1973 |
| 3,895,434 | Sudano | Apr. 23,1974 |
| 4,430,940 | Jermunson | Feb. 14, 1984 |
| 4,494,332 | Matievich | Jan. 22, 1985 |
| 4,519,156 | Shaw | May 28, 1985 |
| 4,867,039 | Dobbins | Sep. 19, 1989 |
| 4,989,359 | Kinkner, et al | Feb. 5, 1991 |
| 5,012,744 | Sowash | May 7, 1991 |
| 5,016,538 | Sowash | May 21, 1991 |
| 5,157,210 | Davis | Oct. 20, 1992 |
| 5,341,587 | Phillips, Jr. | Aug. 30,1994 |
| 5,388,523 | Rossmann | Feb. 14, 1995 |
| 5,706,599 | Knight | Jan. 13, 1998 |
| 5,987,797 | Dustin | Nov. 23, 1999 |
| 6,513,274 | Vastag | Feb. 4, 2003 |
| 7,007,609 | Meyer, et al | Mar. 7, 2006 |
| 8,714,144 | Zadra | May 6, 2014 |
| 9,074,832 | Collins | Jul. 7, 2015 |
| 9,441,899 | Micklethwaite | Sep. 13, 2016 |

-continued

| PAT. NO. | INVENTOR | ISSUED |
|---|---|---|
| 9,541,343 | Dodson | Jan. 10, 2017 |
| 9,719,762 | Langenbeck | Aug. 1, 2017 |
| 2010/0059032 | Zabra | Mar. 11, 2010 |

DISCLOSURE OF THE INVENTION

An auxiliary caliber weapon system that allows a conventional shotgun such as a pump action shotgun or other firearm, to fire a selected caliber round which is loaded via the shotgun's standard magazine. The system includes a barrel assembly having a hub sleeve bush, a shotgun barrel sleeve, an auxiliary caliber barrel shank and an auxiliary caliber barrel. Located at a distal end of the barrel is front sight with a front sight attachment member, and located adjacent the barrel's distal end is a take down mount, also with a take down mount attachment member.

To facilitate the use of other, auxiliary rounds with the shotgun, an adapter is utilized. The adapter is dimensioned exactly the same as the size of the shotgun shell which is being converted. The adapter is preferably made of a thin metal or plastic and has an outer surface, an inner surface, and a head case face. Extending along and equidistantly positioned on the head case face and down the body of the adapter are preferably three slots. At the center of the head case face is an auxiliary caliber round inlet that allows a round to be inserted and maintained within the adapter. The inlet is dimensioned such that a round's first end, which has a standard extractor groove, is tightly placed with the inlet on an inlet groove and circularly extends into the round's extracted groove. The inlet expands during insertion of the round, and once the round is inserted and clicked in place, pressure contract that maintains the round in a substantially straight position within the adapter on center. The size of the adapter's inlet will vary, depending on the round caliber that is used.

In order to convert a shotgun to load and fire the auxiliary caliber round within the adapter, a person simply removes the stock shotgun barrel and replaces the barrel with the system's barrel assembly. It should be noted, that as with the adapter, the barrel assembly is designed to accept a particular auxiliary caliber round. By use of this system, instead of having or transporting multiple guns of various calibers, a person will only need to have a single shotgun, which can remain functional as a shotgun, and also have multiple barrel assemblies with the adapters. It is much easier to store or transport a single shotgun with multiple barrels than multiple guns of various calibers.

Once the barrel assembly has been attached to the shotgun, the adapter(s), with inserted selected caliber rounds are loaded into the shotgun's magazine. The number of adapters that can be loaded into the shotgun's magazine is the same number of standard shotgun shells that can be loaded. As the shotgun pump is actuated the adapter will be loaded and can be fired. Each subsequent pump action will eject the adapter with empty auxiliary caliber shell, and load another. This action can be repeated until the magazine is empty. If a person decides they need or desire a different caliber, the barrel assembly is simply replaced and the appropriate caliber adapters are loaded.

As an additional embodiment, an ACWS can be used to fire auxiliary caliber ammunition from a larger caliber artillery weapon. The functionality of using the adapter in a larger caliber artillery weapon such as a cannon is the same as it is for a shotgun. The only difference is that the adapter is scaled up to fit the dimension of the cannon ammunition. The use of auxiliary caliber ammunition in an artillery cannon can provide significant benefits, especially in cost savings. During certain actions such as training, a large quantity of ammunition is used. By replacing the standard ammunition with auxiliary caliber ammunition a major cost saving can be achieved.

In view of the above disclosure, the primary object of the invention is to produce a an auxiliary caliber weapon system that utilizes a barrel assembly to allow a person to quickly and easily convert a conventional shotgun, other firearm or cannon to fire ammunition rounds of a selected caliber.

In addition to the primary object of the invention it is also an object of the invention to provide an auxiliary caliber weapon system that:

- facilitates quick and easy conversion of a shotgun or other firearm,
- is reliable and safe,
- reduces the number of guns that must be stored or carried,
- is especially useful for "preppers" and other survivalists,
- reduces the cost of target shooting by allowing the use of small caliber, low-cost ammunition
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose a preferred embodiment with multiple design configurations of an an auxiliary caliber weapon system (ACWS). Firearms are available in a large variety of types, sizes and calibers. The three common categories of firearms include rife, shotguns, a handguns, all of which can have multiple shapes and sizes, as well as the caliber of the ammunition a firearm shoots. The type and caliber of a selected firearm depends on the requirement of use and preference of the person using the firearm. For ease of carrying or concealment, a handgun is typically preferred. For an activity such as animal hunting, a rifle is most commonly used, and for bird hunting or skeet shooting a shotgun is usually chosen.

Figure 7:
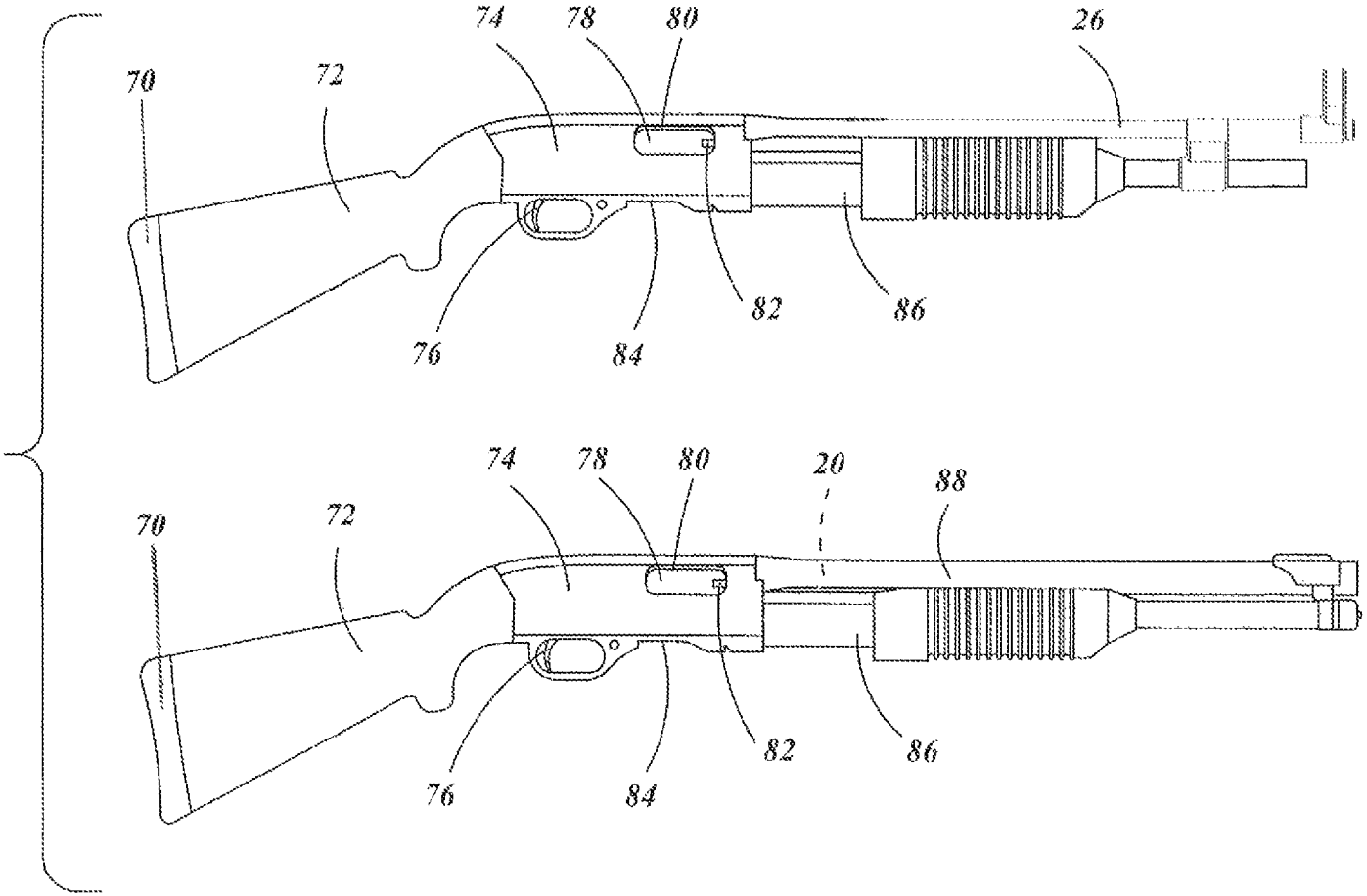
FIG. 7 is an elevational side view of the conventional shotgun and a shotgun with the system's auxiliary caliber barrel.

If a person participates in multiple activities, they do not have a choice but to purchase, store and transport multiple type of firearms. It is not only expensive to purchase multiple firearms, but they must be safely stored when not in use, which often requires the ownership of a gun safe. Also, a major drawback is that when a person requires the use of multiple guns at a distant location such as on a hunting and camping trip, all of the guns must be carried to the location. The auxiliary caliber weapon system 10 provides a solution to these problems by allowing a conventional shotgun to be modified to fire other calibers of centerfire or rimfire ammunition. The system 10 utilizes a shotgun platform to which barrels of various caliber can be attached, as shown in FIG. 7. A person will then be able to selectivity choose to fire the standard shotgun shell or any other caliber ammunition, while only needing to own and carry the shotgun and a barrel for each caliber. A specially designed shotgun shell adapter facilities the use of the interchangeable barrel on the shotgun.

The ACWS 10, as shown in FIGS. 1-12, is essentially comprised of a barrel assembly 12 and a shotgun shell adapter 48. The barrel assembly 12 is designed to be used with a specific manufacturer's shotgun, thereby possibly requiring modification to the barrel assembly 12 design. These modifications are anticipated and do not deviate from the scope of the inventive concept. The system 10 can effectivity be adapted and utilized for use with any type of shotgun 70, with the only requirement being the shotgun's use of a conventional shotgun.

Figure 1:
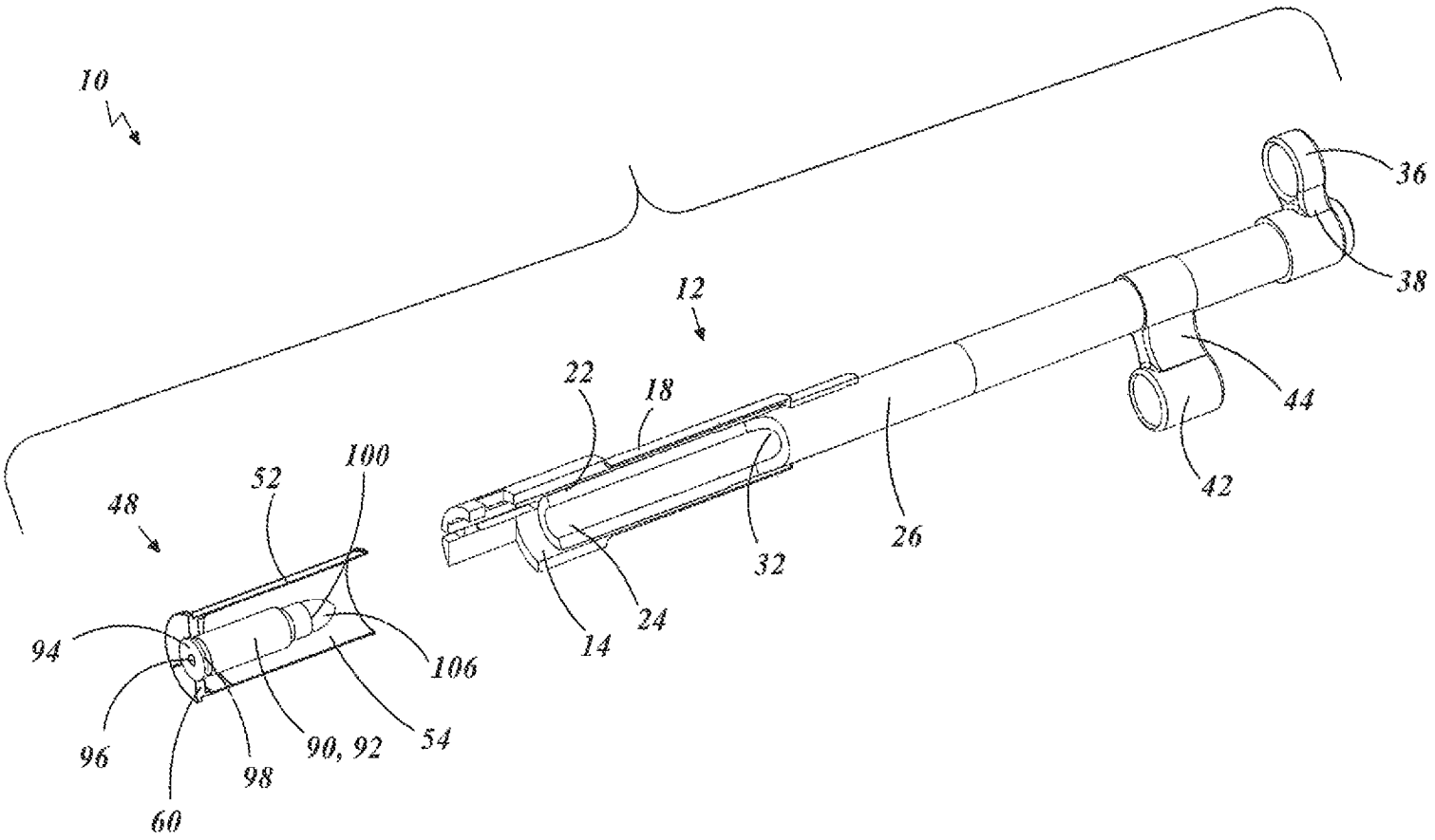
FIG. 1 is an orthographic view of a an auxiliary caliber weapon system showing a barrel assembly and a shotgun shell adapter.
Figure 2:
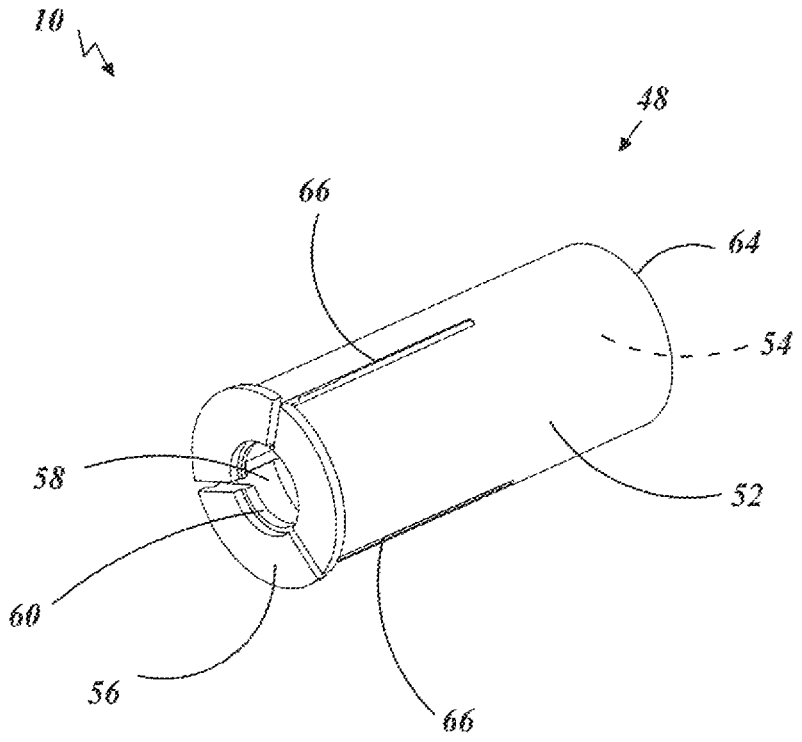
FIG. 2 is an orthographic rear view of the adapter.
Figure 3:
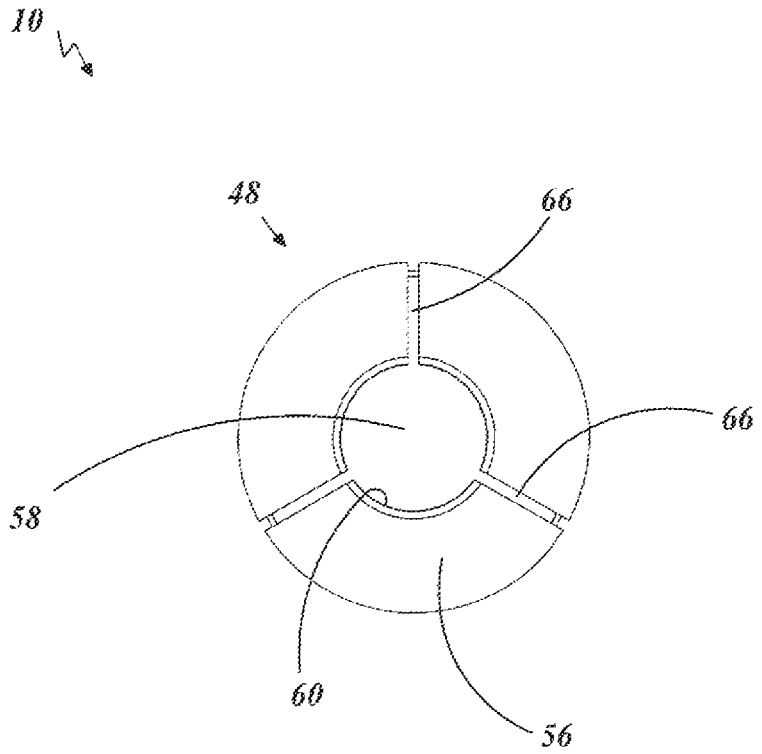
FIG. 3 is an elevational rear view of the adapter.
Figure 4:
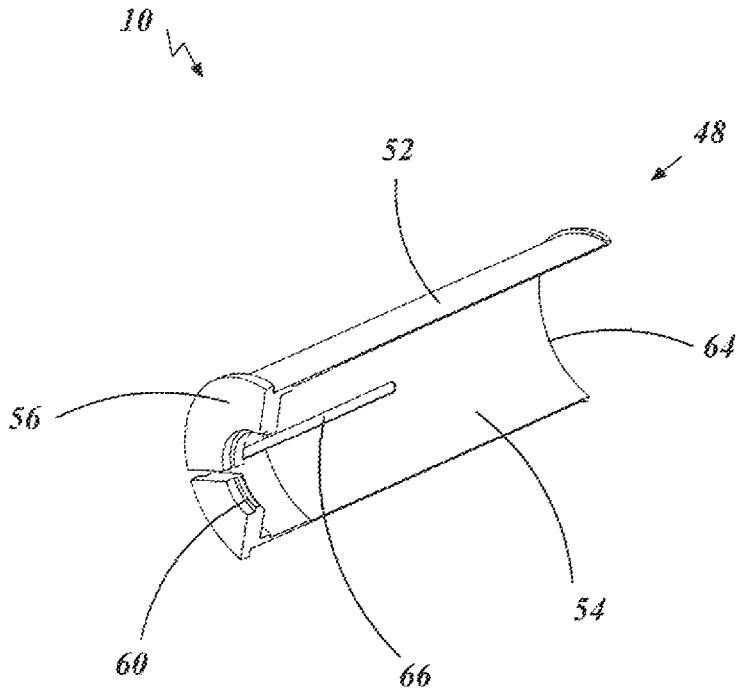
FIG. 4 is an orthographic cut-away view of the adapter.
Figure 12:
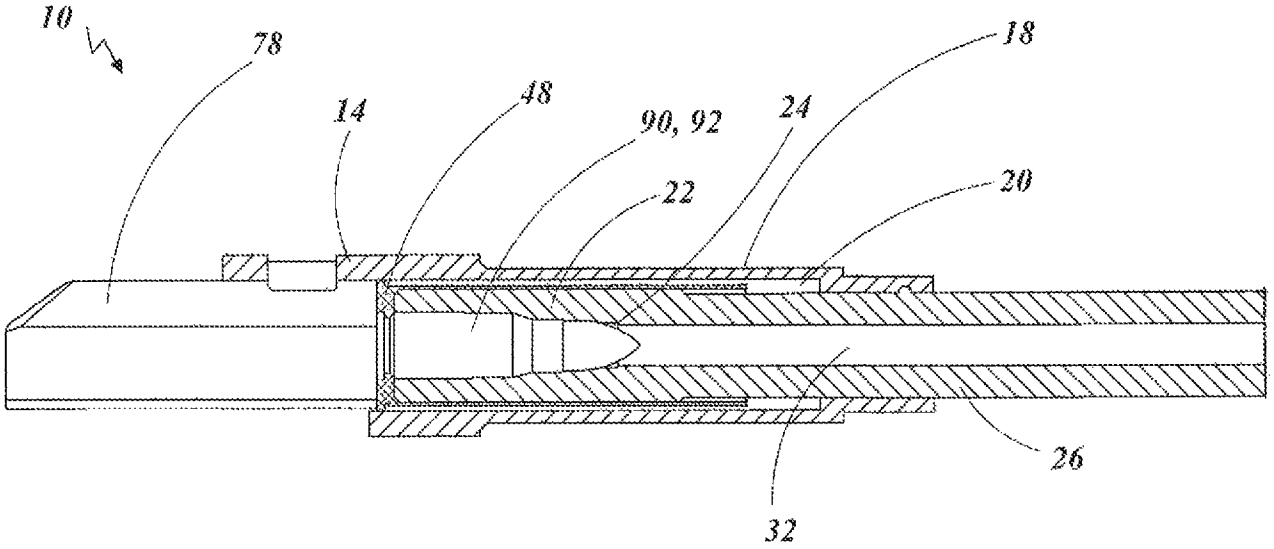
FIG. 12 is a side cut-a-way view of the barrel assembly

As shown in FIGS. 1 and 12, the barrel assembly 12 is comprised of a hub sleeve bush 14 that functions as a receiver interface. A shotgun barrel sleeve 18 barrel connection section having a shotgun chamber 20 is integrally attached to and extends forward from the hub sleeve bush 14. The shotgun chamber is located within an auxiliary caliber barrel shank 22, which also includes an auxiliary caliber chamber 24.

Extending forward from the shotgun barrel sleeve 18 is an auxiliary caliber barrel 26 having a rifled barrel bore 32 therethrough. Located at the barrel distal end is a front sight 36 that is secured by a front sight attachment member 38. Located adjacent the barrel distal end is a take down mount 42 that is secured by a takedown mount attachment member 44. Each auxiliary barrel acts as an attachment and converts a shotgun to a rifle. The auxiliary barrel replacements are made according to instructions in an existing shotgun factory manual and the barrel is longer than a shotgun's magazine 86. The ACWS barrel assembly has two chambers, one inside the other, as shown in cut-a-way in FIG. 12. One of the chambers is the shotgun chamber 20 and the other is the auxiliary caliber rifled chamber 24. Around the shotgun chamber 20 and auxiliary caliber barrel shank 22 is a space for the adapter 48 to be inserted. When the shotgun 70 is actuated, such as by pump action, the adapter 48 moves from the magazine 86 to the shotgun chamber 20, exactly between the shotgun chamber 20 and auxiliary caliber barrel shank 22 and an auxiliary caliber ammunition round 90 moves to the auxiliary caliber chamber 24. The barrel assembly is made specifically to correspond to the gauge of any conventional shotgun, and is designed to replace the shotgun's original barrel, by fitting into the receiver of the shotgun. Similar barrel systems used for artillery or cannon have the same functionality, only the dimensions are different.

Figure 5:
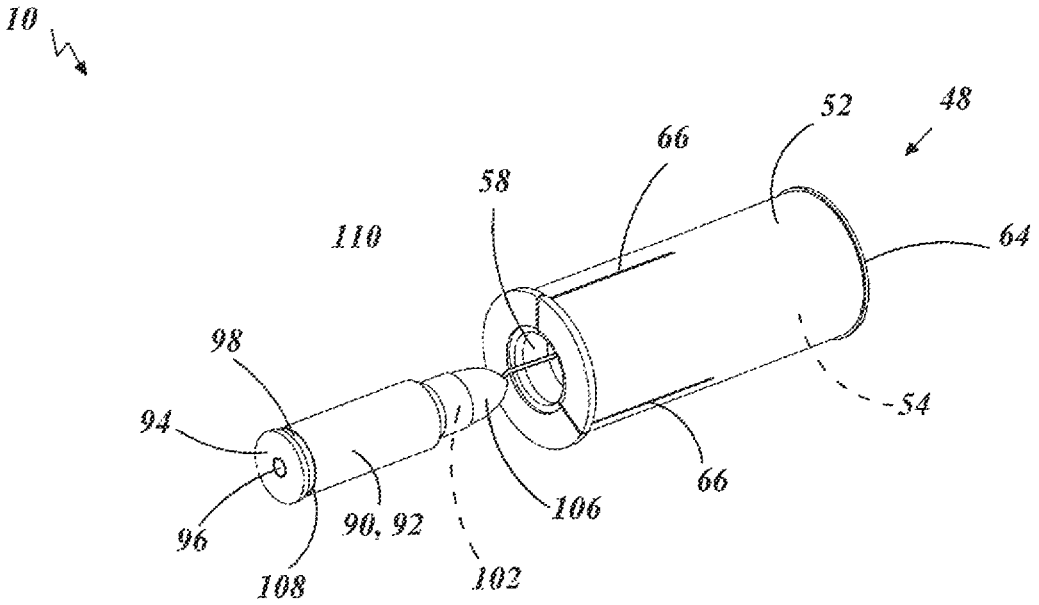
FIG. 5 is an elevational side view of the adapter with an ammunition round about to be inserted.
Figure 6:
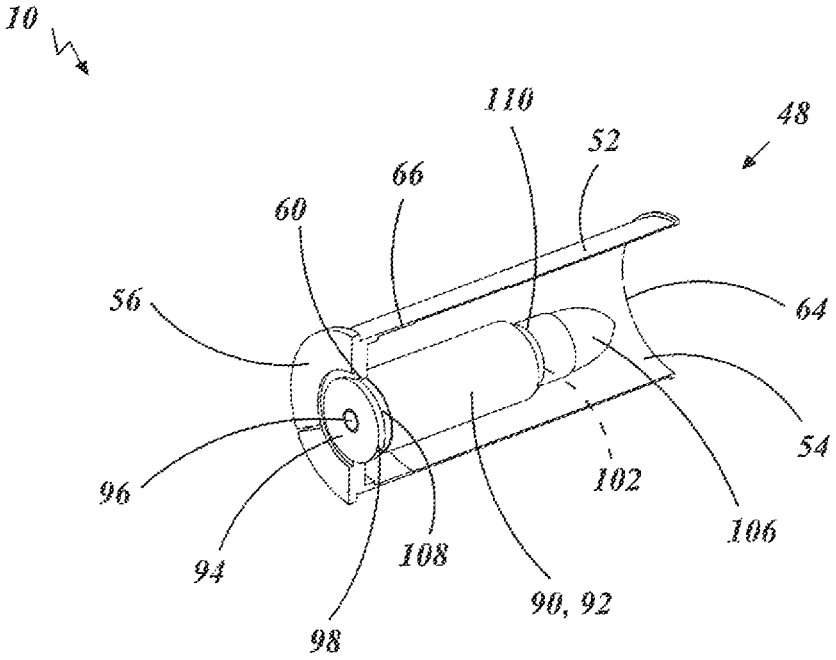
FIG. 6 is a cut-away view of the adapter with an ammunition round inserted.

The second element of the ACWS 10 is the adapter 48 which is a single component, integrally constructed as one piece, with no mechanical function. As shown in FIGS. 1-6, the adapter 48 is comprised of an outer surface 52, an inner surface 54 and a head case face 56 having an auxiliary caliber round inlet 58 with a groove 60 extending along an inner perimeter. Extending along and equidistantly positioned on the head case face 56 and down the body of the adapter 48 are preferably three slots 66. The adapter 48 also has an open end 64 opposite the head case face. The adapter 48 is designed to resemble a shotgun round casing and functions as a three-section jaw action that grips the auxiliary caliber round by applying pressure. An auxiliary caliber round 90 is inserted into the adapter 48 through the auxiliary caliber round inlet 58 on the head case face 56, as shown in FIGS. 5 and 6. The jaw side of adapter expands and contracts back to form, with assistance from the three slots 66, when a round is inserted or extracted from the adapter. Once clicked into place, the auxiliary caliber round is securely held by the jaw action. The groove 60 on the auxiliary caliber round inlet 58 is designed to interface and circumvent the diameter of a round's extractor groove 98. It should be noted that the inlet groove 60 is a mirror image of an auxiliary caliber round extractor groove 98. Once the round is inserted, the auxiliary caliber round inlet 58 compresses and grasps the round along the perimeter of the extractor groove 98, as shown in FIG. 6. There is enough force on the round to maintain the round in a straight, centered position within the adapter 48. This is important because the adapter's inner surface interfaces 54 with the barrel shank 22, and the round must be directed straight into the auxiliary caliber barrel chamber 24. To extract an empty shell from the adapter 48 the most efficient method is to insert an object (even a person's finger) into the adapter and simply push the empty shell out of the adapter from the open end 64.

As previously disclosed, the ACWS 10 functions with a conventional shotgun 70. As shown in FIG. 7, the shotgun 70 includes a stock with a grip 72, and a receiver 74 having a trigger 76, a bolt 78, an ejection port 80, an extractor 82 and a loading port 84. Positioned within and connected to the receiver 74 is an internal magazine 86. The shotgun 70 also has a barrel 88 which is quickly and easily removable.

The ammunition round 90 can either be a centerfire type or a rimfire type. The round 90 includes a cartridge case 92 with a first end 94 having a primer opening 96 and the previously disclosed extractor groove 98, as shown in FIGS. 5 and 6. A second end 100 of the cartridge case has an opening 102 into which is inserted a bullet 106 with a first end 108 ad a typically pointed or rounded second end 110.

The barrel assembly 12 is made of metal such as steel, and the adapter 48 is preferably made of a thin metal, plastic or a composite. The barrel assembly 12 is longer than the shotgun magazine, and the adapter is dimensioned the same as the shotgun shell of the shotgun that is modified.

To use the ACWS 10, a person removes the standard shotgun barrel. The system's barrel assembly 12 is attached onto the shotgun, with the assembly 12 interfacing with the shotgun's receiver 74. An auxiliary caliber ammunition round is inserted into the adapter 48 as previously disclosed. The adapter 48 with round is then placed into the magazine 86 via the loading port 84. The shotgun pump is then actuated which loads the adapter 48 with an auxiliary caliber round into the chambers 20,24 from where it can be fired.

When the shotgun pump is again actuated, the now roundless adapter is ejected through the ejection port 80 and a new adapter with round is loaded from the magazine. This action can be repeated up to the number of adapters with rounds that are placed into the magazine.

Figure 11:
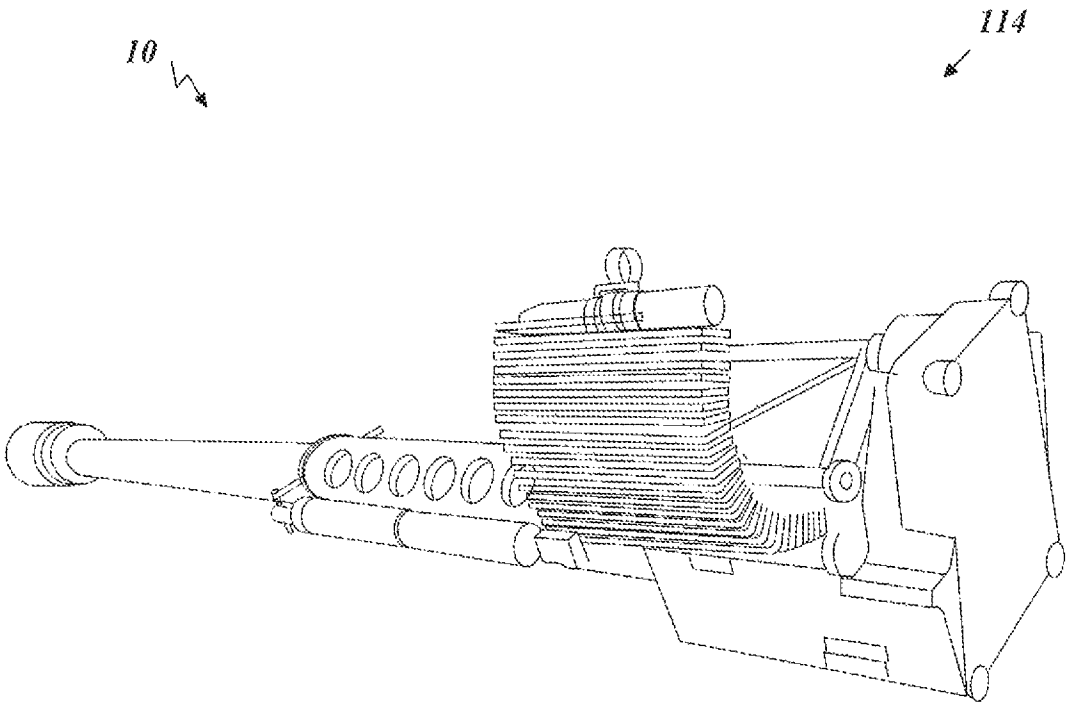
FIG. 11 is an elevational side view of a conventional artillery cannon, also known as a chain gun.

In an alternate embodiment, the ACWS 10 can be utilized to fire an auxiliary caliber ammunition round from a larger caliber artillery weapon, such as a cannon, as shown in FIG. 11. The ACWS is especially viable for this purpose since there is a significant cost for each ammunition round fired from a cannon. This problem is exacerbated when it is realized that during training of soldiers to use a cannon, a large number of ammunition rounds must be fired. There have been attempts to offer a solution to this problem, but there is no solution that utilizes the adapter 48 of the ACWS 10.

A benefit of using the ACWS is that it is mainly a matter of scale of the ease adapter. The inventive concept of using the adapter to load and fire auxiliary caliber ammunition into a larger caliber cannon is essentially the same as for a shotgun. For use with a cannon, the adapter is designated as element 50 and the other element designators are the same as the adapter.

Figure 8:
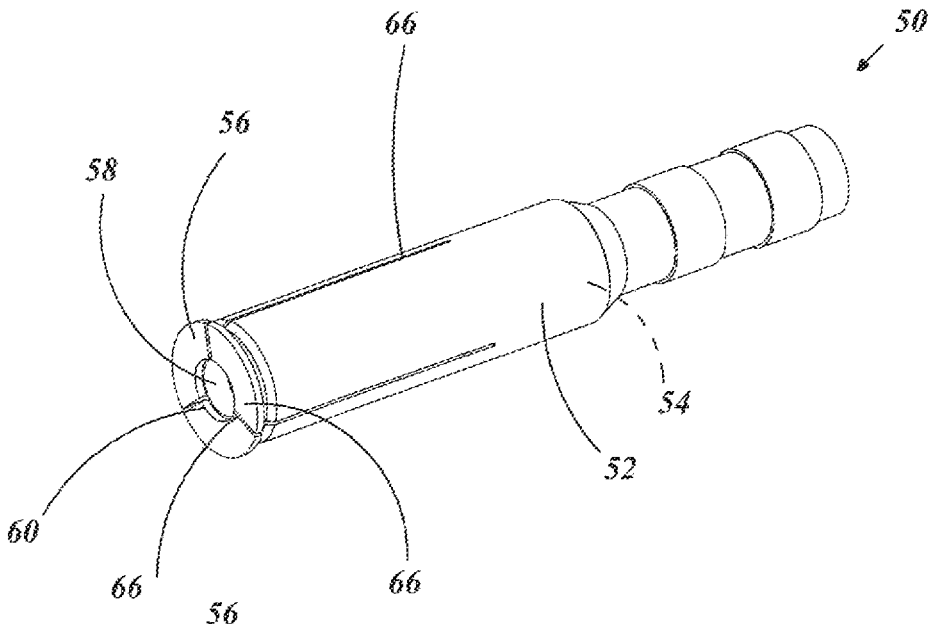
FIG. 8 is an elevational side view of an artillery shell adapter.
Figure 9:
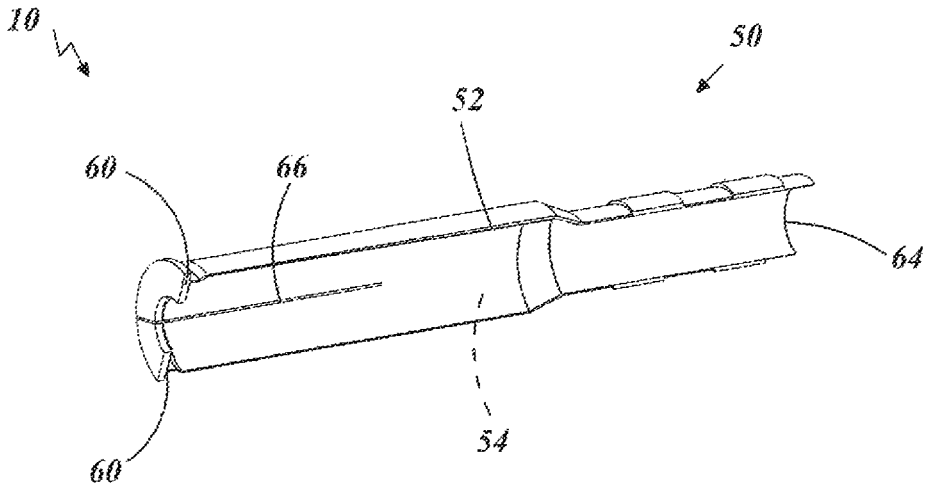
FIG. 9 is an elevational cut-away view of the artillery adapter.
Figure 10:
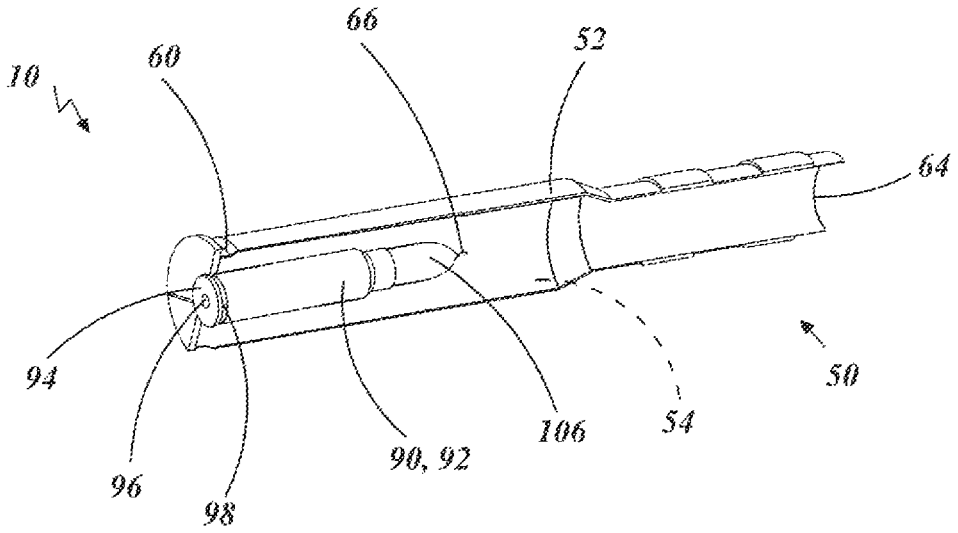
FIG. 10 is an elevational cut-away view of the artillery adapter with an auxiliary round inserted.

As shown in FIGS. 8-10, the adapter 50 is correspondingly dimensioned to accept an auxiliary caliber ammunition round. For whichever type of cannon is used, the adapter 50 is specifically shaped, as shown in FIGS. 8-10. This is important because a training crew learning to use/fire a cannon will become familiar with and be able to manipulate the adapter 50 and when necessary, easily be able to switch to the conventional ammunition. Also, the ACWS 10 can be used with artillery weapons such as a chain gun which ammunition is fed into via an ammunition belt that maintains a multiplicity of ammunition rounds in-line, ready for use. As long as the adapter 50 is similarly shaped and dimensioned as a large caliber ammunition round, the ACWS can be effectively utilized for an artillery weapon such as a cannon.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. An auxiliary caliber weapon system (ACWS) comprising:

a barrel assembly including:

a hub sleeve bush configured as a shotgun receiver interface, a shotgun barrel sleeve having a chamber, and attached to and extending from the hub sleeve bush, a shotgun chamber, an auxiliary caliber barrel shank configured adjacent to the shotgun chamber, an auxiliary caliber chamber, an auxiliary caliber barrel extending from the auxiliary caliber chamber and having a rifled bore therethrough, a shotgun shell adapter having:

a head case face having an auxiliary caliber round inlet with a groove, three slots configured longitudinally on the adapter, and extending on the head case face to the inlet, the three slots cause the inlet to enlarge when pressure is applied on the slots, thereby facilitating the insertion of a round into the adapter via the inlet, an open end that allows a bullet to exit the adapter when fired and provides access to push on a fired shell for extraction of the shell from the adapter via the inlet, a shotgun including:

a receiver with an ejection port for ejecting a shell or misfired round, an extractor for extracting a shell or misfired round, and a loading port for loading a round, an internal magazine, and a barrel that is removable to allow an ACWS barrel assembly to be attached onto and interface with the shotgun receiver, the barrel configured to receive an ammunition round of an auxiliary caliber into the adapter which is configured to be placed in the shotgun magazine, the shotgun magazine configured to be positioned within the shotgun receiver during use.

2. The auxiliary caliber weapon system of claim 1 wherein the barrel assembly is longer than the shotgun magazine.

3. The auxiliary caliber weapon system of claim 1 wherein the inlet groove is a mirror image of an ammunition round's extractor groove.

4. The auxiliary caliber weapon system of claim 1 wherein the barrel assembly is configured to interfaces with shotgun receivers of multiple makes and models of shotguns.

5. The auxiliary caliber weapon system of claim 1 wherein the barrel assembly further comprises a front sight with attachment means located adjacent an upper distal end of the barrel.

6. The auxiliary caliber weapon system of claim 1 wherein the barrel assembly further comprises a take down mount with attachment means located a lower distal end of the barrel.

7. The auxiliary caliber weapon system of claim 1 wherein the adapter comprises a material selected from the group consisting of metal, plastic and composite.

8. An auxiliary caliber weapon system (ACWS) comprising:

a barrel assembly comprising:

a hub sleeve bush configured as a shotgun receiver interface, a shotgun barrel sleeve having a chamber, and attached to and extending from the hub sleeve bush, a shotgun chamber, an auxiliary caliber barrel shank configured adjacent to the shotgun chamber, an auxiliary caliber chamber, an auxiliary caliber barrel extending from the auxiliary caliber chamber, and having a rifled bore therethrough, a front sight configured at a distal end of the barrel assembly and including a front sight attachment member, a take down mount configured adjacent the front sight and including a take down mount attachment member, an adapter with a particular shotgun shell size, the adapter having:

a first end, a second end, an outer surface, an inner surface, a head case face having an auxiliary round inlet with a groove, three slots that cause the inlet to enlarge when pressure is applied on the slots, thereby facilitating the insertion of a round into the adapter via the inlet, an open end that allows a bullet to exit the adapter when fired and provides access to press on a fired shell for extraction of the shell from the adapter via the inlet, a shotgun including:

a rearward extending stock with a downward-extending grip, a receiver having:

a trigger, a bolt positioned within the receiver, an ejection port for ejecting a shell or misfired round, an extractor for extracting shell or misfired round, a loading port for loading a round, an internal magazine and a barrel that is removable to allow an ACWS barrel assembly to be attached onto and interface with the shotgun receiver, an ammunition round of a selected caliber is inserted into the adapter, which is then placed via the loading port into the shotgun magazine from where the adapter is loaded into the shotgun receiver, ready to be fired.

9. The auxiliary caliber weapon system of claim 8 wherein the barrel assembly is longer than the shotgun magazine.

10. The auxiliary caliber weapon system of claim 8 wherein the barrel assembly interfaces with shotgun receivers of multiple makes and models of shotguns.

11. The auxiliary caliber weapon system of claim 8 wherein the adapter is made of a material selected from the group consisting of metal, plastic and composite.

12. The auxiliary caliber weapon system of claim 8 wherein the adapter accepts centerfire ammunition.

13. The auxiliary caliber weapon system of claim 8 wherein the adapter accepts rimfire ammunition.

14. The auxiliary caliber weapon system of claim 8 wherein the ammunition round comprises an extractor groove.

15. The auxiliary caliber weapon system of claim 8 wherein the inlet groove is a mirror image of the ammunition round extractor groove.

* * * * *